United States Patent [19]

Matys

[11] 4,025,140

[45] May 24, 1977

[54] LOCKING DEVICE FOR THE PRONGS OF AN ELECTRICAL PLUG

[75] Inventor: Edwin J. Matys, Mount Prospect, Ill.

[73] Assignee: Tula Machine Co., Inc., Chicago, Ill.

[22] Filed: Nov. 28, 1975

[21] Appl. No.: 636,133

Related U.S. Application Data

[63] Continuation-in-part of Ser. No. 494,077, Aug. 2, 1974.

[52] U.S. Cl. ..... 339/37; 85/45

[51] Int. Cl.[2] ..... H01R 13/54

[58] Field of Search ..... 339/37, 39, 82; 70/229; 85/45

[56] References Cited

UNITED STATES PATENTS

| | | | |
|---|---|---|---|
| 379,200 | 3/1888 | Hanlon | 85/45 |
| 2,654,073 | 9/1953 | Katz | 339/37 |
| 3,273,442 | 9/1968 | Launay | 85/45 |

FOREIGN PATENTS OR APPLICATIONS

| | | | |
|---|---|---|---|
| 966,272 | 10/1950 | France | 85/45 |
| 201,856 | 8/1923 | United Kingdom | 339/82 |

*Primary Examiner*—Gerald A. Dost
*Attorney, Agent, or Firm*—Bruce K. Thomas

[57] ABSTRACT

In one embodiment a protective housing adapted to be locked upon and cover a prong of an electrical plug is disclosed. The housing has a chamber to receive a prong of the plug and has a collared recess and threaded bore on one side communicating with the chamber to receive a lock screw that impinges upon the prongs. The head of the lock screw is guidably received in the collared recess and has a side slot. A key is provided with a tab at one end that engages the slot and the collared recess allows the key to turn the lock screw to and from its locked position against the prong.

In another embodiment a lock screw with a slotted head and key therefor is described wherein the bottom contour of the slot is provided with convolutions conforming with the extended end edge of the blade of a key therefore adapted to turn the lock screw within a housing to impinge the end of the screw against the prong of an electrical plug thereby holding the housing over the prongs so that unintentional connection to an outlet is prevented.

10 Claims, 8 Drawing Figures

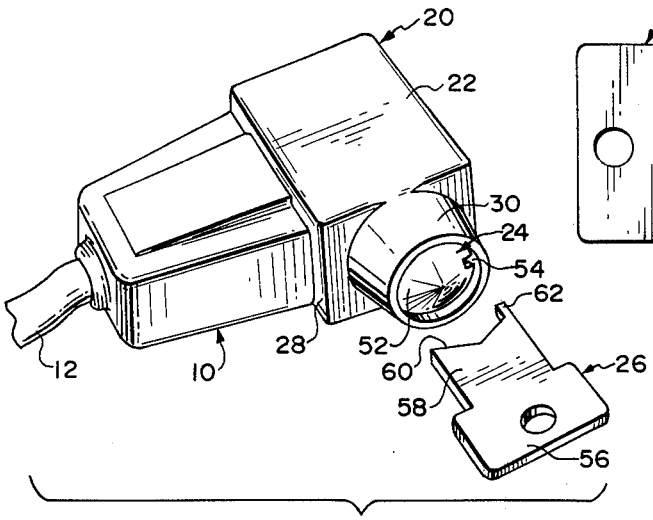
FIG. 1
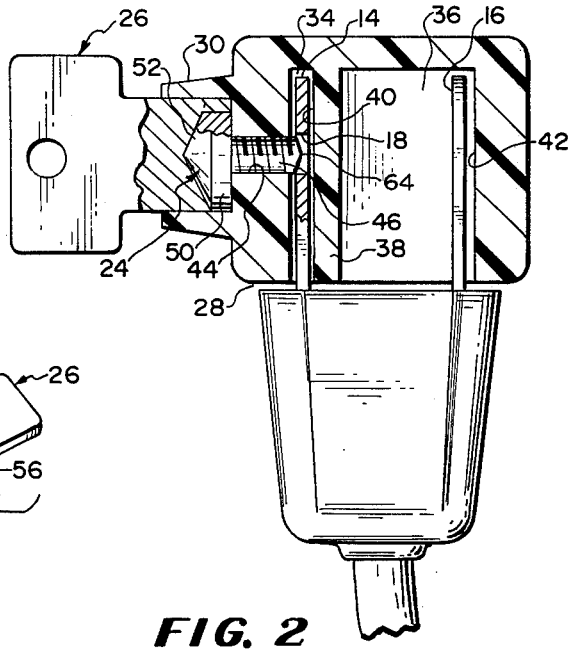
FIG. 2
FIG. 3
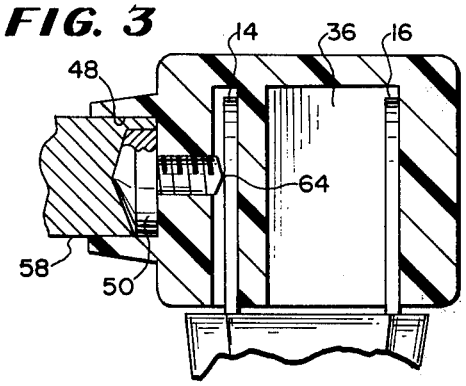
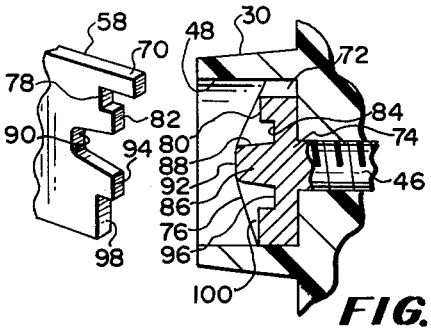
FIG. 4
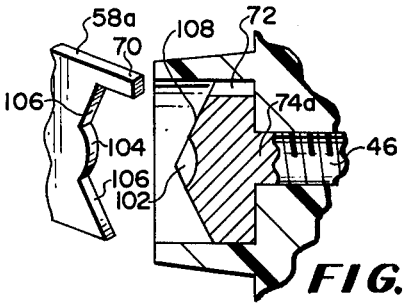
FIG. 5
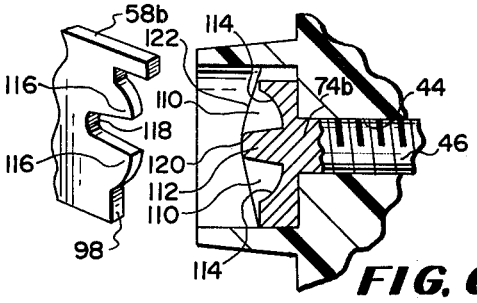
FIG. 6
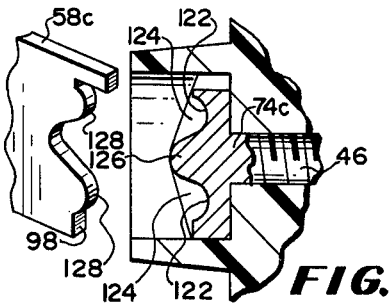
FIG. 7
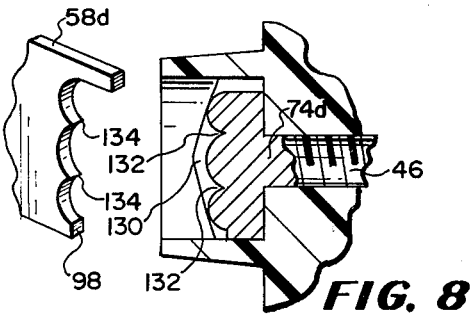
FIG. 8

LOCKING DEVICE FOR THE PRONGS OF AN ELECTRICAL PLUG

RELATED APPLICATIONS

This application is a continuation-in-part of application Ser. No. 494,077, filed Aug. 2, 1974, by the instant inventor and bearing the same title.

BACKGROUND OF THE INVENTION

Locking devices for electrical plugs as are used on electrical cords for appliances, tools, motors and other electrically driven devices, are old. Illustrative prior art includes Katy U.S. Pat. No. 2,654,073 wherein a springloaded detent is reciprocated by a key-operated barrel which engages the detent through a cam arrangement. Other art discloses different shapes of bolt heads and slotted screw heads for use with shaped wrenches and screw drivers.

SUMMARY OF THE INVENTION

A housing is disclosed having a side opening to receive and cover the prongs of an electrical plug. The housing has a threaded bore extending through one side and opening at its inner end to the side or edge of one of the prongs. The threaded bore has an enlargement defined by a circular collar at the other end to receive and provide a seat for the head of a lock screw engageable within the threaded bore to impinge against the side of the prong or engage within a recess or hole in the prong and thus fix the housing over the plug so that the prongs are not exposed and the plug cannot be used.

The head of the lock screw is enlarged and fits within the collar in peripheral guided relationship. The head of the locking screw haas a slot on one side, may be flat, concave or contoured outwardly and in one embodiment is provided with a transverse slot extending across its diameter. At one end the slot extends longitudinally to the inner base edge of the head of the lock screw.

The key therefore is adapted to engage the head by means of a flat extension and provide a tool whereby the lock screw is turned into the threaded bore and the head of the lock screw is recessed within the collar so that it is difficult if not practically impossible to unscrew the lock screw with any other tool than the key.

The flat extension of the key has an edge that is contoured to fit the face of the screw head or to fit the contours of the slot and also has a side extension or tab that fits into the longitudinal extension of the slot. The contours of the end of the key or of the slot and key are such that the use of a tool other than the key to release the lock screw is thwarted.

DESCRIPTION OF THE DRAWINGS

Illustrative embodiments of the invention are shown in the drawings wherein:

FIG. 1 is a perspective exploded view of a locking device and key, in accordance with this invention, shown attached to a plug;

FIG. 2 is a partial cross-sectional view of the device of FIG. 1;

FIG. 3 is a fragmentary partial cross-sectional view of the locking device of FIGS. 1 and 2 shown attached to a plug the tines of which have no holes;

FIGS. 4, 5, 6, 7 and 8 are fragmentary views of modified keys and cross-sectional views of the corresponding locking screws in accordance with another embodiment of this invention.

DESCRIPTION OF THE PREFERRED EMBODIMENT

Referring to FIGS. 1 and 2, there is shown the electrical plug 10 having the cord 12 with the pair of spaced conductive prongs 14 and 16, the former having the aperture 18 therethrough and located intermediate its ends. The plug 10 is formed of molded insulating plastic or rubber and the prongs 14 and 16 are connected to the conductive leads in the cord 12 in a manner known in the art. These plugs are generally of standard dimensions and designed to fit the normal household or industrial outlet. The prongs 14 and 16 may be solid or formed of thin sections bent into juxtaposition. The prong 16 may also be provided with a bore 18, the purpose of which is to engage a spring detent in some electrical outlets. Such a detent would be of equal size and transversely opposite the bore 18 in the prong 14.

The locking device 20 of this invention comprises three parts, the housing 22, the locking screw 24 and the key 26. The housing 22 is formed of molded insulating rigid plastic such as a thermoset or thermoplastic resin. A phenolic resin can be suitably used. The housing 22 is essentially rectangular in configuration, presenting flat outside walls 28 on five sides with the protruding collar 30 on one side. The housing 22 need not be of this configuration as long as one of the walls 28 is essentially flat so that the plug 10 fits thereagainst in substantially close proximity so that the prongs 14 and 16 are covered, as will be described. Thus, the plug 10 can fit flush or be spaced at the interface 32.

The housing 22 is provided with a pair of compartments indicated at 34 and 36, each defined by enclosing walls that are open at one side 28 at right angles to the collar 30. The compartment 34 is slightly larger than the prong and is separated from the compartment 36 by the dividing wall 38. The compartment 36 is larger in one dimension than the compartment 34 to accommodate plugs having prongs of different lateral spacing, as illustrated. Each compartment has a depth longer than the total length of the prongs 14 and 16 and their widths need only be sufficient to allow the prongs to be easily inserted therein. As illustrated, the compartment 34 is closely spaced about the prong 14 and the distance between the inside surface 40 of the wall 38 and the inside surface 42 of the compartment 36 is about the same if not greater than the center-to-center spacing of the prongs or their right-hand surfaces (as view in FIG. 2) for a purpose to be described.

The housing 22 has the threaded bore 44 to receive the threaded shank 46 of the lock screw 24. The bore 44 is preferably centered within the larger bore 48 (see FIG. 4) defined by the collar 50, and extends into communication with the prong compartment 34.

The lock nut 24 has the head portion 50 which fits in guided relationship within the bore 48. The head portion has the conical top surface 52 and a small radial slot 54 at the periphery. The top surface 52 can be flat or concave as desired. The slot 54 can extend all or part way along the side of the side of the head 50 to and toward the flat bottom of the head. This impingement of the shank 48 against the prongs may force the plug sideways slightly within the compartments 34 and 36.

The key 26 has the enlarged flat head 56 and the flat shank 58. The end of the key is notched at 60 to conform with the conical top 52 of the head of the lock screw. The end of the key 60 would have the opposite configuration for a locking screw with a concave top surface 52. At one side of the notch 60 there is provided the tongue or tab 62 which fits within the slot 54 and preferably extends to the bottom thereof. The shank 58 is as wide as the inside diameter of the larger bore 48 with sufficient tolerance to rotate therein in guided relationship as the key is turned to lock or unlock the lock screw 24.

As illustrated in FIGS. 2 and 3, the threaded shank 46 of the lock screw engages within the threaded bore 44 of the housing and is long enough to present, when tightened, its pointed tip 64 into the hole 18 of prong 14. Thus located, the housing 20 cannot be removed from the plug 10 without the use of the key 26. FIG. 3 shows the prong locking device in position upon a plug the prongs of which are not perforated. In this instance, the tip 64 is made to impinge and dig into the prong with sufficient force to hold the device on the plug.

In practice, however, it has been found that this type of key works well within the larger bore 48 as long as the turning of the key is guided therein as the plug is used repeatedly, as might be the case in a machine shop, laboratory or garage where electrical tools must often be protected from unauthorized use. Also considerable torque is sometimes required to turn the key 26 since the lock screw 24 tneds to become set within the plastic threads 44. Also when using the device with non-perforated prongs, as in FIG. 3, where some pressure must be applied by the point 64, the key shank 58 is amply guided by the bore 48 and the device becomes properly seated.

Referring to FIG. 4, the key shank 58 is provided with the extension or tab 70 which fits into the open-ended slot 72 of the modified lock screw 74 having a generally conical top surface 76. The tab 70 has the straight portion 78 which conforms with the straight portion 80 of the irregular slot that has been provided in lock screw 74. The key has a shorter tab 82 which fits into and conforms with the radial indentation 84 of the slot. This indentation is off-center and joins the center portion 86 of the head to define a tapering wall 88. The key has the larger rounded notch 90 that fits over the central portion 86. The juncture 93 of the top surface 76 of the head conforms with the end of this center portion 86 so that there is no one place that a blade or other instrument can be inserted to get a purchase on the head.

The key further is provided with the second shorter tab 94 which conforms with the second radial indentation 96. Lastly the key has the wall 98 which registers partly in the shallow upstanding end portion 100 of the slot.

Because of the presence of the upstanding straight portions 80 and 100 in the head and the discontinuity of the slot due to the center portion 86, it is extremely difficult to turn the lock screw with any other instrument than the key 70.

The lock screw 74*a* in FIG. 5 is modified from that of FIGS. 2 and 3 in that a central arcuate depression or notch 102 is provided, while retaining the tab 70 and the open-ended slot 72 in the lock screw head. In this embodiment the shank end of the key 58 *a* has the central rounded protuberance 104 bordered by the sloping walls 106 on each side which conform respectively with the notch 102 and the conical top surface 108 of the head of the lock screw 74*a*. The notch 102 is far too small in which to gain a purchase, but in combination with the slot 72 greatly improves the facility with which the device can be attached or released from the plug.

The embodiment of FIG. 6 is related to that shown in FIG. 4 except that the radial indentation 110 on each side of the central portion 112 of the modified lock screw 74*b* is provided with the oppositely extending arcuate walls 114 which conform with the arcuate tabs 116 of the key shank 58*b*. The notch 118 is essentially the same as the notch 90 shown in FIG. 4 and fits over the central portion 112. The juncture 120 of the top rounded surface 122 of the screw head can be coincidental with the central portion 112 or provide a slight depression there across for additional purchase at this point with the inner end of the notch 118.

In FIG. 7 the configuration of the slot in the head of the lock screw 74*c*is modified by having the conforming circular walls 122 defining the radial indentations 124 on each side of the rounded central portion 126. The modified key shank 58*c* has the corresponding rounded tabs 128 which fit into these indentations.

Lastly in FIG. 8, the lock screw 74*d* has the convoluted slot 130 with two pointed depressions 132 spaced therealong to receive the pair of points 134 on the key shank 58*d*. Corresponding parts of the key and lock screws are given similar numbers for simplicity in this description.

The plug lock of this invention can be formed to provide one chamber or compartment 34 to receive one prong of an electrical plug or formed with two such chambers 34 and 36 so that both prongs are covered. The chambers 34 and 36 can be shaped to conform with arcuate prongs as are found on twist type plugs. Thus the plug lock of this invention can be formed to fit two, three or four pronged twist type plugs using only one chamber 34. In this event the chamber 34 may be arcuate in cross-section since twist type plugs have arcuate prongs.

What is claimed is:

1. A locking device to cover a prong of an electrical plug and prevent inadvertent use comprising:
   - a housing defining a chamber opening to one side thereof and adapted to receive and cover a prong of an electrical plug;
   - said housing having a collared recess on a second side adjacent said one side;
   - a threaded bore extending from said recess into communication with said chamber;
   - a locking screw engageable within said threaded bore for pressure contact with said prong within said chamber;
   - said locking screw having a head portion guidably received within said collar;
   - said head portion having an outer face and a slotted side; and
   - a key member having a shank portion with an end matable with the face of said head portion of said locking screw and a tab portion receivable in said slotted side whereby upon engagement of said key member with said head portion of said locking screw allows said locking screw to be turned into and out of said pressure contact with said prong.

2. A locking device in accordance with claim 1 in which:
   - said head portion has an outer contoured face; and
   - said shank portion of said key member has a contoured end matable with the contoured face of said head portion of said locking screw.

3. A locking device in accordance with claim 1 in which:

said head portion has an outer conical face; and said shank portion of said key member has a conical contoured end matable with the contained face of said head portion of said screw member.

4. A locking device in accordance with claim 1 in which:

said housing defines a second open-ended chamber having an outer wall and an internal wall between said first and second chambers adapted to receive and cover a second prong of an electrical plug; and the lateral distance between one side of said internal wall defining said first chamber and the inside of said outer wall is substantially the same as the lateral spacing of said prongs whereby the pressure contact of said locking screw upon said one prong forces the respective prongs against the inner sidewalls of said chambers.

5. A locking device to cover the prongs of an electrical plug and prevent inadvertent use comprising:

a housing defining a pair of adjoining substantially perpendicular sidewalls;

a pair of chambers extending through one of said sidewalls adapted to receive and cover the prongs of an electrical plug;

a threaded bore extending through the other sidewall in communication with one of said chambers and having a collared recess at the other end;

a locking screw engageable within said threaded bore and having a head portion guidably received by said collared recess;

said head portion having an outwardly facing conical end;

a key slot in said conical end, said slot having its longitudinal axis extending in a line diametrically through the apex of said conical end;

said key slot having a contoured bottom defining a central protuberance and a straight walled side portion opening to the base of said head portion; and a key member having a shank portion;

said shank portion terminating in a contoured edge matable with the contoured bottom of said slot and having a tab mating with said open side portion of said slot.

6. A locking device in accordance with claim 5 in which:

said contoured bottom of said slot in said head portion includes at least one depression spaced from the center and sides of said locking screw head and said central protuberance extends to and defines said central apex of said head portion.

7. A locking device in accordance with claim 5 in which:

said contoured bottom of said slot includes at least a pair of indentations having arcuate outside walls and angular inside walls terminating at the central protuberance of said lock screw.

8. A locking device in accordance with claim 5 in which:

said contoured bottom of said slot includes at least a pair of arcuate indentations and an arcuate central protuberance.

9. A locking device in accordance with claim 5 which:

said contoured bottom of said slot includes at least a pair of arcuate protuberances with pointed depressions therebetween.

10. A locking device in accordance with claim 5 in which:

said contoured bottom includes protuberances which extend into coincidence with the top surface of said screw head portion.

* * * * *